United States Patent [19]

Gloystein et al.

[11] 4,389,761

[45] Jun. 28, 1983

[54] CONTAINER COUPLING WITH SPLIT HOUSING

[75] Inventors: Jürgen F. G. Gloystein, Osterholz-Scharmbeck; Klaus G. Szirniks, Bremen, both of Fed. Rep. of Germany

[73] Assignee: Conver Ingenieur-Technik GmbH & Co. KG, Bremen, Fed. Rep. of Germany

[21] Appl. No.: 193,687

[22] Filed: Oct. 3, 1980

[30] Foreign Application Priority Data

Nov. 17, 1979 [DE] Fed. Rep. of Germany ..... 2946509

[51] Int. Cl.[3] ..... B63B 25/24

[52] U.S. Cl. ..... 24/287; 410/82

[58] Field of Search ..... 285/419, 373; 24/287; 410/82, 77, 84, 78, 85

[56] References Cited

U.S. PATENT DOCUMENTS

| | | | |
|---|---|---|---|
| 895,143 | 8/1908 | Augensen | 285/419 |
| 1,228,323 | 5/1917 | Hudgins | 285/419 |
| 1,649,752 | 11/1927 | Stone | 285/419 |
| 1,928,316 | 9/1933 | Muto | 285/373 |
| 2,721,582 | 10/1955 | Hoke | 285/419 |
| 3,258,822 | 7/1966 | Schliesch et al. | 285/373 |
| 3,691,595 | 9/1972 | Backteman et al. | 24/287 |
| 3,752,511 | 8/1973 | Racy | 24/287 |
| 3,820,474 | 6/1974 | Backteman et al. | 410/82 |
| 3,894,493 | 7/1975 | Strecker | 24/287 |
| 4,082,052 | 4/1978 | Looks | 24/287 |

FOREIGN PATENT DOCUMENTS

| | | | |
|---|---|---|---|
| 2248736 | 4/1973 | Fed. Rep. of Germany | 410/82 |

*Primary Examiner*—Paul J. Hirsch

*Attorney, Agent, or Firm*—Sughrue, Mion, Zinn, Macpeak & Seas

[57] ABSTRACT

A coupling fitting for releasably joining adjacent corners of sea shipment containers comprises a housing 10 having a central passage 11 for accommodating a rotatable bolt 12 having locking bars 13, 14 integral with its opposite ends. The bars extend outwardly of centering bosses 16, 17 which project from opposite sides of a central support flange 15 of the housing and enter slots 20 of container corner fittings, whereafter they are rotated to lock the containers together by turning the bolt 12. The housing is axially divided into two mating halves 21, 22 by an interfacing plane 23. One of the halves has undercut, hook-like projections 26 internally of each boss on one side of the passage 11, and pyramidal centering projections 31 on the other side. These projections engage in correspondingly configured recesses 27, 34 in the other housing half, and the assembled halves are secured together by pins extending through aligned bores 35, 36 in the bosses and pyramidal projections.

7 Claims, 8 Drawing Figures

CONTAINER COUPLING WITH SPLIT HOUSING

DESCRIPTION

Figure 1:
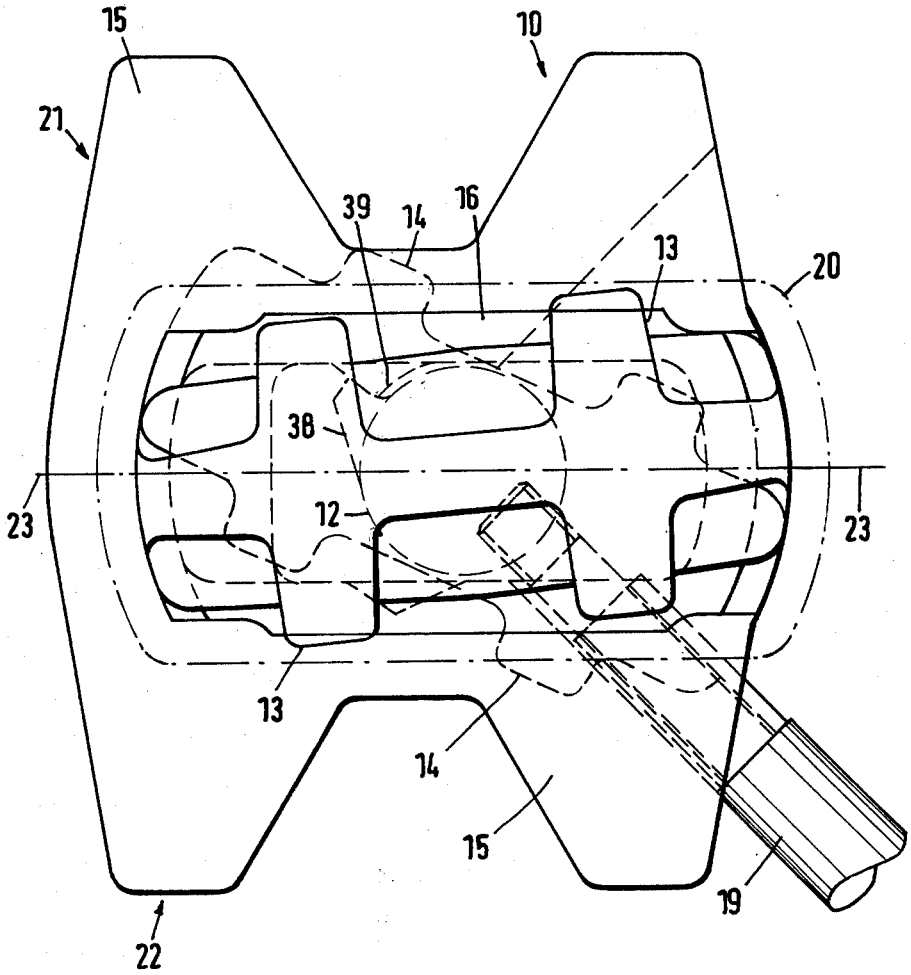

The invention relates to a container coupling for the releasable connection of corner fittings of adjacent containers, especially containers arranged above one another, with a housing consisting of at least two housing parts (housing halves) connected to one another, in which housing there is mounted a locking bolt with at least one locking bar introducible into the corner fitting of a container.

The container couplings indicated by the present invention are used predominantly for the connection of containers stacked above one another on the decks of oceangoing ships. These couplings are accordingly arranged between containers stored on top of one another, so that two directly adjacent corner fittings of the containers are connected releasably to one another.

Two constructions, different in fundamental structure and in handling, of such container couplings are known in practice. The one of the constructions discussed here is provided with a (lower) anchoring foot which is part of the housing and is therefore introduced by turning same into the respective corner fitting. On the side lying opposite this foot the locking bolt emerges with a crossbolt from the housing. The other type of container coupling is equipped with a locking bolt which passes through the housing. This locking bolt is provided at both ends with a locking bar which fits respectively into the lower and upper corner fitting. The invention applies to both of the above-mentioned and to any further constructions.

In the case of a container coupling of the last-mentioned type, the housing which consists of an approximately central supporting flange and of upper and lower centering bosses is often made in two parts. A vertical bounding surface face extends through the supporting flange and the two elongate centering bosses in the longitudinal direction of these. This division of the housing makes it possible or easier to manufacture said housing of cast material and to assemble same with the introduction of the locking bolt provided with locking bars. German Offenlegungsschrift No. 2,153,933 shows an exemplary embodiment of such a container coupling. The two housing halves are, here, connected to one another by means of screw bolts which pass transversely through the housing in the region of the centering bosses above and below the supporting flange. However, the introduction of the screw bolts as connecting elements for the housing halves is expensive in terms of labour and materials. In addition, the screw bolts do not stand up to the various possible loads which can act upon the housing of a container coupling.

The object of the invention is to develop further a container coupling with split housing, so that said coupling can be manufactured with a lower expenditure of materials and labour and also has a higher loading capacity.

To achieve this object, the container coupling according to the invention is characterised in that the housing parts are connected to one another in a positively-locking manner.

According to the invention, the housing parts to be connected to one another have projections and depressions which are moulded-on, that is to say, especially made integrally in a casting process and which enable the housing parts to be assembled by being engaged into one another in a positively-locking manner. In an especially advantageous embodiment, one housing part is provided with at least one especially hook-shaped projection which has an undercut and which fits into a recess, provided with corresponding undercuts, of the other housing part. At a specing from this positively-locking connection point between the housing parts a centering is effected by means of separate centering elements which likewise fit into matching recesses of the respective other housing part. Finally, according to the invention, in order fully to secure the connection, connecting elements in the form of spring pins, bolts or the like which pass through the respective parts can be introduced. Said connecting elements are appropriately introduced from outside into the assembled housing through bores aligned with one another.

The positively-locking connections between the housing parts withstand heavy loads. They offer a comprehensive safeguard against relative displacements of the housing parts to one another. The manufacture of these is very simple, since the respective projections and other anchoring and connecting elements are made integrally with the respective housing parts in one operation. To secure the connection, it is necessary, as a final measure, merely to introduce a spring pin, bolt or other connecting element from outside, namely into aligned bores which, for reasons of accuracy, are appropriately made only after the housing parts have been assembled.

A further feature relates to the safeguard of the locking bolt within the housing against turning into undesirable positions, in such a way that an actuating lever which is connected to the locking bolt and is guided in a slot-shaped recess of the housing is not moved by the action of forces from outside abruptly to butt against lateral limitations of the recess and thereby broken off. The respective safeguard consists of a stop which is attached laterally to the locking bolt and which, under the above-mentioned load, runs against a lug attached at a corresponding point in the housing.

Figure 2:
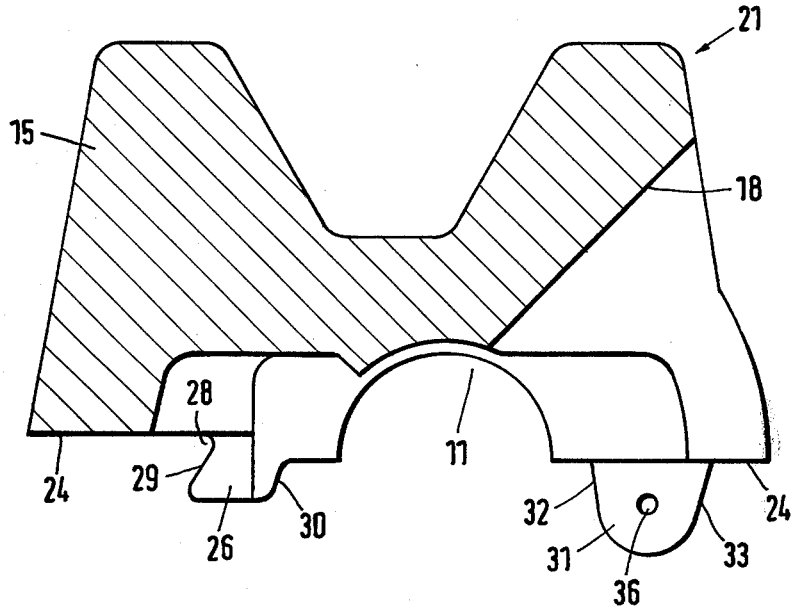
Figure 3:
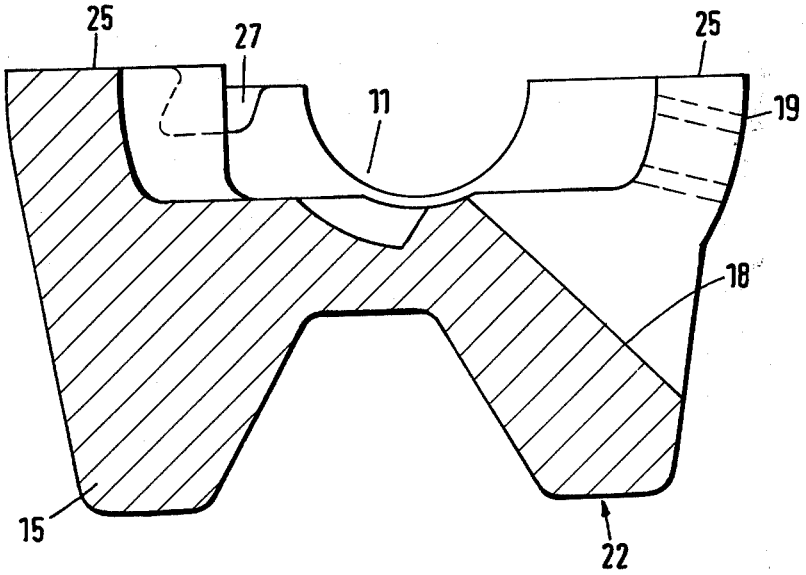
Figure 4:
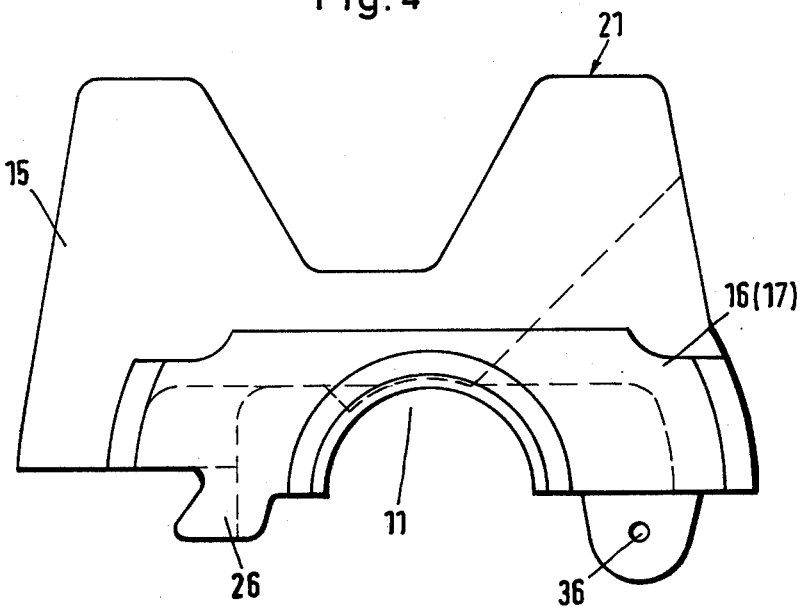
Figure 5:
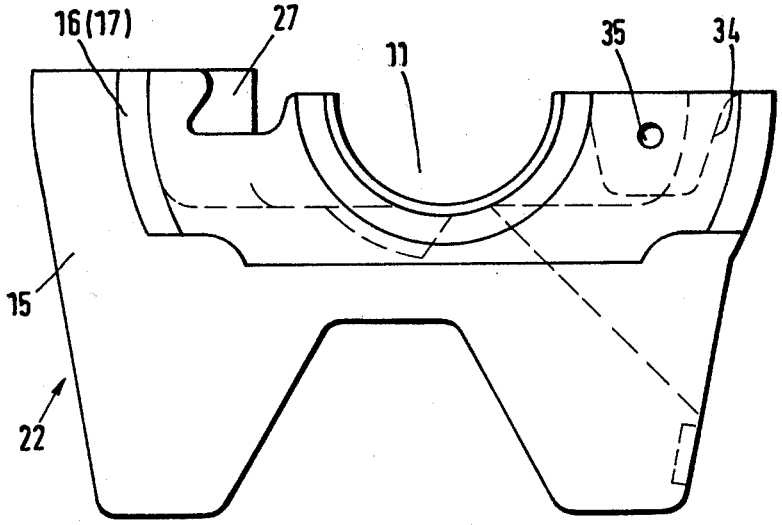
Figure 6:
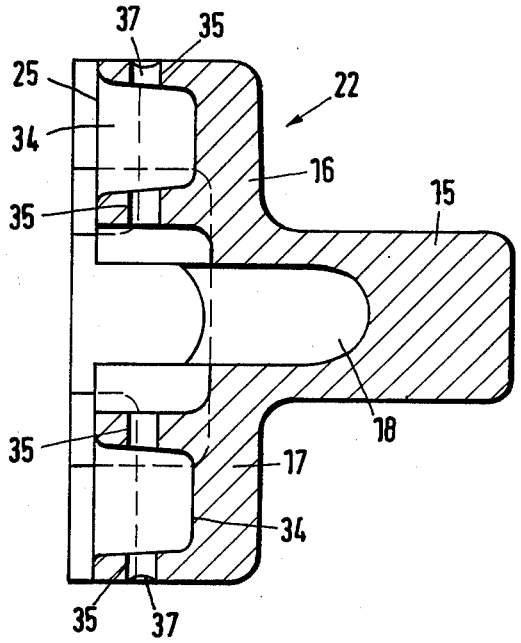
Figure 7:
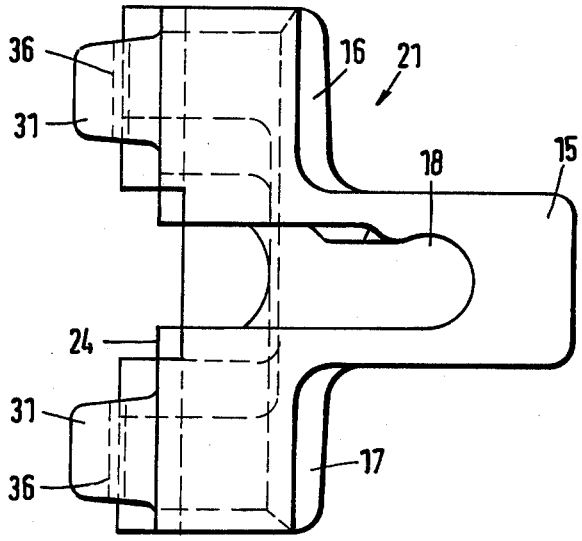
Figure 8:
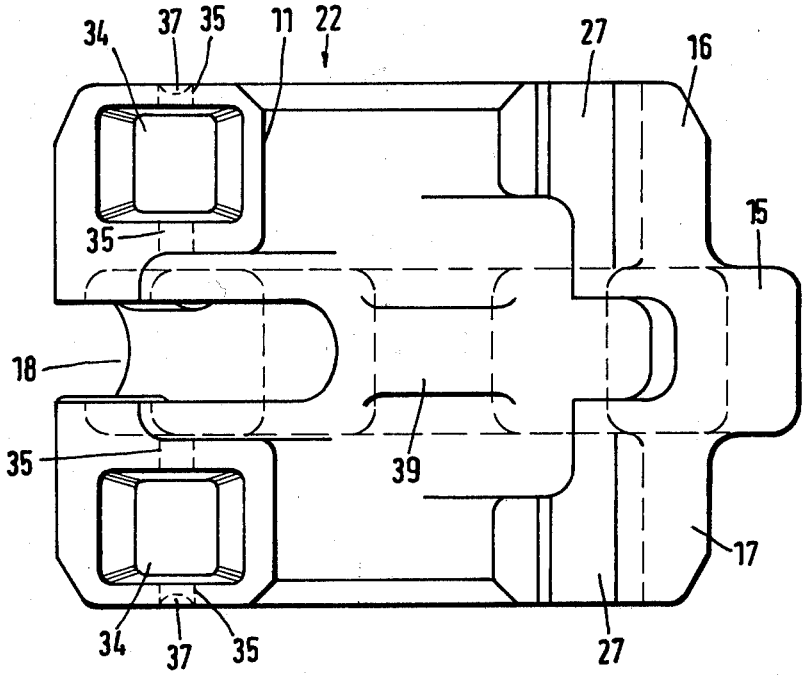

One exemplary embodiment of the invention is described in more detail below with reference to the drawings wherein:

FIG. 1 is a simplified plan view of a container coupling,

FIGS. 2 and 3 show spatially separated housing parts of a container coupling in horizontal section at the level of a supporting flange of the housing, FIGS. 4 and 5 are plan views of the housing parts according to FIGS. 2 and 3, FIG. 6 is a vertical section through one of the housing parts, FIG. 7 is a side view of the other housing part to FIG. 6, FIG. 8 is a top view of one of the housing parts.

The container coupling illustrated in the drawings as an exemplary embodiment consists of a housing 10, for example of a cast material. A locking bolt 12 is mounted turnably in this housing 10 in a passage 11 with a partly circular cross-section. Tranverse locking bars 13 and 14 are attached to the ends of this locking bolt, preferably forming a common workpiece integral with the locking bolt 12.

The housing 10 forms approximately in the central region a supporting flange 15 projecting all round and centering bosses 16 and 17 on both sides of same. In the region of the supporting flange 15 there is formed on one side a slot-like recess 18 in which a hand lever 19 connected to the locking bolt 12 is displaceably mounted. The locking bolt 12 can be turned from outside by means of this hand lever 19.

To connect two containers (not shown) arranged above one another, the centering bosses 16 and 17 are introduced into an opening 20 respectively of the lower and upper corner fitting of the adjacent containers. The locking bars 13 and 14 emerging at the bottom and top from the housing 10 project, in so doing, into the standardised corner fittings. By turning the locking bolt 12 by means of the hand lever 19 the locking bars 13,14 are brought into a position transverse to the opening 20 of the corner fittings. In this position (not shown in the drawings) the two containers are connected to one another via the coupling.

In the present exemplary embodiment the locking bars 13,14 are attached to the locking bolt 12 in a manner offset to one another. Different positions of the locking bars 13 and 14 are thereby possible.

In the exemplary embodiment illustrated the housing 10 is made in two parts. It accordingly consists of the housing parts 21 and 22. The parting plane lies approximately in a central plane 23 of the housing 10 which extends in the longitudinal direction of the centering bosses 16 and 17.

To manufacture a complete housing 10, the housing parts 21,22 are joined to one another by marrying their mutually opposite bounding surfaces 24 and 25 and are connected to one another. For this purpose, the bounding surfaces 24,25 are provided with projections 26 and depressions 27 which engage into one another in a fitting and positively-locking manner.

In the exemplary embodiment illustrated the housing part 21 is provided on one side in respect of the opening 11 with a hook-like anchoring projection 26 which, with the housing 10 assembled, fits into a correspondingly designed depression 27 of the other housing part 22. The anchoring projection 26 and, correspondingly, the depression 27 form an undercut 28 by means of an obliquely rebounding side face 29 of the anchoring projection 26. A second side face 30 lying opposite thereto is directed approximately parallel to the side face 29 and has a smaller depth than the first-mentioned side face 29. Because of the corresponding design of the depression 27, it is thereby made easier to introduce the anchoring projection 26 into the depression 27 despite the undercut 28.

As may be seen especially from FIG. 8, in the exemplary embodiment illustrated, two such anchoring projections 26 are arranged above one another, that is to say, above and below the supporting flange 15, with corresponding depressions 27 in the opposite housing part 21,22.

To secure and centre the connection between the housing parts 21 and 22 by means of the anchoring projection 26 in the depression 27, further connecting elements are provided on the bounding surfaces 24 and 25. A centering projection 31 is thereby concerned, which in the present case is made conical, that is to say, with converging side faces 32 and 33. With the housing 10 assembled, the centering projection 31 fits into a correspondingly designed depression 34 of the other housing part 22. Preferably, in so doing, the centering projection 31 butts with the side faces 32,33 against the corresponding side faces of the depression 34. Moreover, two of these elements are also always arranged above one another on the side lying opposite the anchoring projections 26 in relation to the opening 11.

To secure further the connection between the housing parts 21 and 22, there is provided, in the present exemplary embodiment, a connecting element which enters aligned bores of parts of the two housing parts 21,22. In the present case, the housing part 22, on the one hand, and the centering projection 31, on the other hand, is provided with a bore 35 and 36 respectively. With the housing 10 assembled, the above-mentioned bores 35,36 are aligned with one another, so that a connecting element, especially a spring pin, can be driven into the bores 35,36.

Appropriately, the procedure in practice is that the bores 35,36 are manufactured after the housing parts 21,22 have been assembled. For this purpose, the housing part 22 is provided at the relevant point with a marking 37 in the form of a depression.

The present container coupling is provided with a safety device against breakage of the hand lever 19. In certain relative positions of the hand lever 19 and consequently of the locking bars 13 and 14, loads are possible from containers placed on top and these loads lead to an abrupt pivoting movement of the hand lever 19, namely especially into the extreme position shown in FIG. 1. In so doing, the hand lever 19 can strike with considerable force against the extreme limitation of the recess 18 and break.

To prevent this effect, the container coupling is provided with a block which ensures that the hand lever 19 cannot be moved into the extreme position and butt againt the extreme limitation of the recess 18. In the present case, this block consists of a stop 38, that is to say, a peg-like projection, which is moulded-on, for example forged-on the locking bolt 12. Assigned to the above-mentioned stop 38 is a counter-stop in the form of a projecting lug 39 in the housing 10, namely on the housing part 21. The stop 38 and lug 39 are adjusted to one another in respect of their relative position in such a way that, before the above-described extreme position of the hand lever 19 is reached, the stop 38 runs against the lug 39 and consequently prevents the hand lever 19 from striking.

We claim:

1. A coupling fitting for releasably locking adjacent corners of stacked shipping containers together, comprising:

(a) a housing (10) defined by two assembled, mating halves (21, 22) and having a central support flange (15) flanked by outwardly extending centering bosses (16, 17), (b) a central passage (11) extending through the flange and bosses for rotatably accommodating a locking bolt (12), (c) the housing being axially divided into the two halves by a central plane (23) passing through the flange and bosses, and having interfacing surfaces (24, 25), (d) undercut hook-like projections (26) extending outwardly from the interfacing surface of one housing half on one side of the passage and from each boss, (e) first recesses (27) defined in the interfacing surface of the other housing half opposite the undercut projections and having configurations complementary thereto.

(f) tapering centering projections (31) extending outwardly from the interfacing surface of one housing half on another, opposite side of the passage and from each boss, (g) second recesses (34) defined in the interfacing surface of the other housing half opposite the tapering projections of said one housing half recited in sub-paragraph (f), said recesses having configurations complementary to said tapering projections, and (h) means for positively securing the tapering projections within their respective recesses upon assembly, whereby after assembly the projections and recesses are fully enclosed within the housing.

2. A coupling according to claim 1, wherein the undercut and tapering projections are on the same housing half and the recesses are in the other, mating housing half.

3. Coupling according to claim 1, wherein the securing means are introduced through aligned bores (35, 36) in the tapering projections and the bosses defining their recesses.

4. Coupling according to claim 3, wherein the securing means are externally introduced pin members.

5. Coupling according to claim 1 wherein the centering projections and their recesses are pyramidal shaped.

6. Coupling according to claim 1, further comprising a hand lever (19) connected to the locking bolt (12) and movable in an arc-like slot (18) of the flange, and limit stop means (38, 39) for preventing the movement of the locking bolt and hand lever beyond a predetermined position.

7. Coupling according to claim 6, wherein the limit stop means comprises a stop (38) on the locking bolt which abuts a lug (39) within the housing.

* * * * *